US005138762A

United States Patent [19]

LeBan et al.

[11] Patent Number: 5,138,762

[45] Date of Patent: Aug. 18, 1992

[54] MODULAR CONNECTOR PRESS

[75] Inventors: Joseph F. LeBan, Elizabeth; Robert F. Levin, Braceville, both of Ill.

[73] Assignee: Panduit Corp., Tinley Park, Ill.

[21] Appl. No.: 649,623

[22] Filed: Feb. 1, 1991

[51] Int. Cl.[5] ..... H01R 43/04

[52] U.S. Cl. ..... 29/749; 29/566.3; 29/759

[58] Field of Search ..... 29/749, 759, 760, 566.3

[56] References Cited

U.S. PATENT DOCUMENTS

| | | | |
|---|---|---|---|
| 4,020,540 | 5/1977 | Casciotti et al. | 29/749 |
| 4,393,580 | 7/1983 | Hall, Jr. | 29/749 |
| 4,479,301 | 10/1984 | Resch | 29/749 X |
| 4,481,710 | 11/1984 | Caveney et al. | 29/749 |
| 4,488,353 | 12/1984 | Caveney et al. | 29/749 |
| 4,505,034 | 3/1985 | Reidt | 29/749 |
| 4,554,733 | 11/1985 | Caveney | 29/749 |
| 4,596,072 | 6/1986 | Shields | 29/749 X |
| 4,654,580 | 3/1987 | Keller | 29/705 X |

*Primary Examiner*—Carl E. Hall

*Attorney, Agent, or Firm*—Charles R. Wentzel; Mark D. Hilliard

[57] ABSTRACT

A modular connector press for terminating different types of connectors to a flat cable includes left and right cable tray assemblies that are mounted for accurately positioning and laterally translating the cable in a first direction transverse to the axial direction of the cable between a loading position for initial positioning of the cable and a termination position where the cable is positioned beneath a press ram. Each tray assembly includes a main body, a cable tray and means for mounting the cable tray to the main body to allow adjustable translation of the cable tray in a second direction transverse to the first direction of translation of the tray assembly means. Each cable tray includes a plurality of connector positioning slots allowing the accurate positioning of terminated connectors of a harness on each cable tray. The left and right tray assemblies can be fastened together to form a two tray unit, each tray of which, with respect to the ram of the press, can be accurately and relatively positioned in the second direction allowing the accurate positioning and termination of a third connector therebetween. The modular press also includes a plurality of different types of interchangeable connector test heads allowing the press to be easily modified to terminate and test a variety of different connectors to a connector harness.

21 Claims, 9 Drawing Sheets

MODULAR CONNECTOR PRESS

TECHNICAL FIELD

The present invention generally relates to connector presses for terminating connectors to conductors to form a connector harness and for testing the harness for short circuit or open circuit faults. Specifically the present invention relates to a modular connector press for assembling and testing connector harnesses of easily varied connector/cable configurations.

BACKGROUND ART

Prior lateral entry connectors and presses for application of these connectors to conductors are described in the following patents owned by our common assignee, Panduit Corp. Reference may be made to U.S. Pat. No. 4,481,710; U.S. Pat. No. 4,488,353 and U.S. Pat. No. 4,554,733. A lateral entry connector comprises two parallel connector parts each initially connected to the other only at a single end, allowing harness conductors to be inserted laterally between the connector parts for subsequent termination of the connector press. One style of termination tooling disclosed in the above '733 patent utilizes a slide means for supporting a flat cable where the slide means is disposed to laterally move between a loading position and a termination position where the flat cable is aligned with the connector parts for subsequent termination by the connector press. Although the prior termination tooling effectively applies a single type of connector to conductors to successfully form a wire harness, specialized construction of the tooling for a single type of connector does not allow the flexible use of the tooling for the construction of wire harnesses of different connector types or of mixed connector types.

Termination tooling having various means to test assembled harnesses for electrical faults have been proposed. For example see U.S. Pat. No. 4,654,580. The prior tooling having means to terminate connectors to wire harnesses and concurrently test the wire harness for electrical faults typically are specially constructed to only terminate and test a single type of connector and are unable to be easily and quickly modified to terminate and test different types of connectors.

Thus there is room for improvement in the art for the provision of a single termination tool that can be quickly and easily modified to construct and test wire harnesses of varied types of connectors.

SUMMARY OF THE INVENTION

It is an object of the present invention to provide a modular connector press that can be easily and quickly modified to accurately terminate connectors of varied types to conductors to form wire harnesses.

It is another object of the present invention to provide a modular connector press that can be easily and quickly modified to test connectors of varied types.

In general a modular connector press for terminating a connector to a flat cable to form a wire harness includes ram means mounted for reciprocation between a first position for receipt of the connector underneath the ram means and an extended position for compression and termination of the connector to the cable and tray assembly means for accurately positioning and laterally translating the cable in a first direction transverse to the axial direction of the cable between a loading position for initial positioning of the cable and a termination position where the cable is positioned beneath the ram means, wherein the tray assembly means includes a main body, a cable tray and means for mounting the cable tray to the main body to allow adjustable translation of the cable tray in a second direction transverse to the first direction of translation of the tray assembly means.

DESCRIPTION OF THE PREFERRED EMBODIMENT

Figure 2:
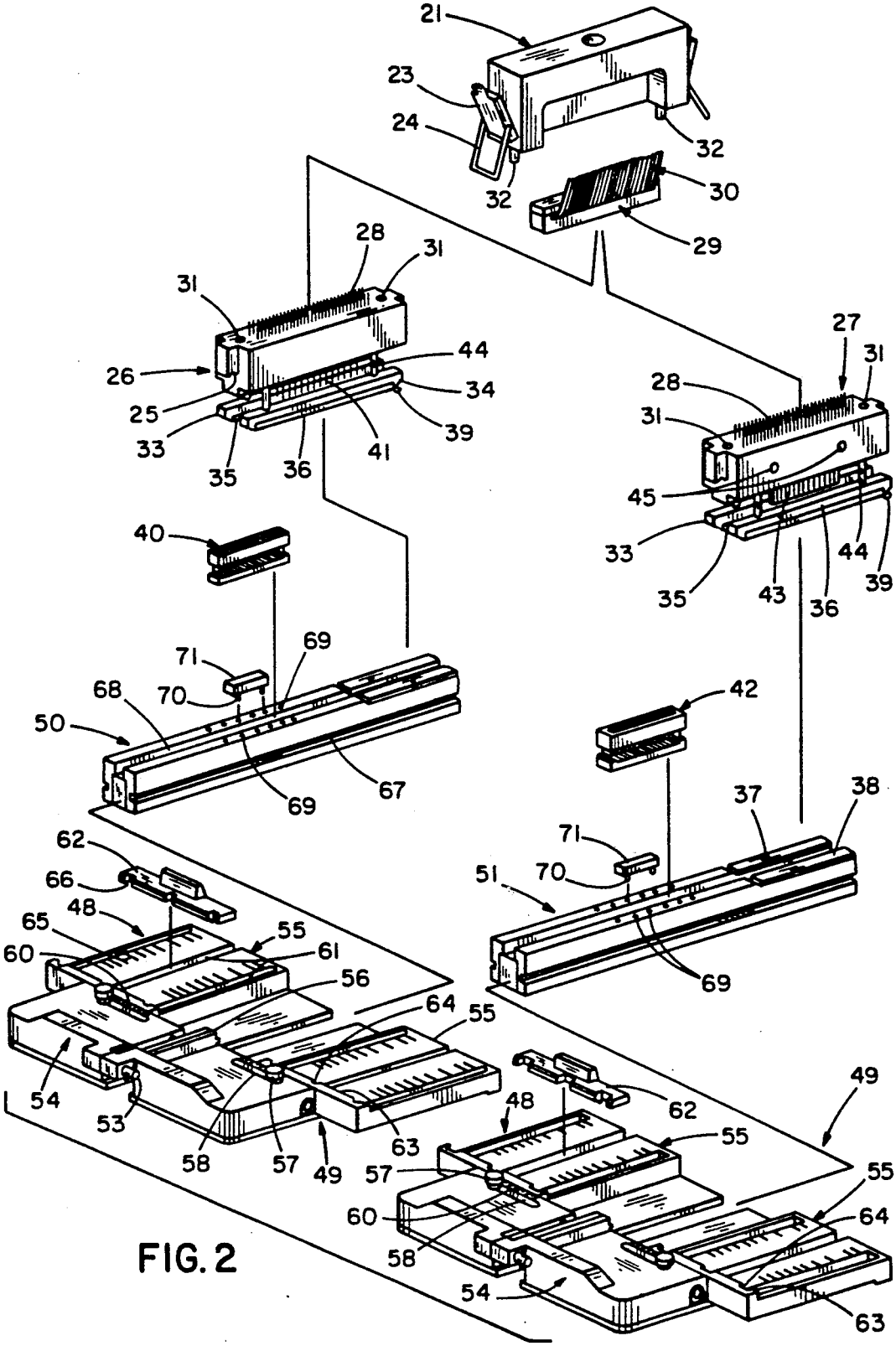
FIG. 2 an exploded assembly view of the connector and cable positioning and testing components of the modular connector press of FIG. 1, with the prime mover and frame of the press removed for clarity.

A modular connector press embodying the concept of the present invention is designated generally by the numeral 20 in the accompanying drawings. Press 20 includes standard electrical, pneumatic or other mechanisms for reciprocating a press ram 21 with sufficient force to terminate a connector to a multiconductor flat cable 22. As seen in FIG. 2, ram 21 includes a pair of toggle clamps 23 that include latching links 24 that engage slots 25 formed on connector test heads 26 or 27 to releasably secure connector test heads 26 or 27 to ram 21.

As best seen in FIG. 2, connector test heads are illustrated for two types of connectors, a socket connector test head 26 and a card edge connector test head 27. Both connector test heads are constructed as modular units that can be quickly, easily and interchangeably mounted to ram 21. Test heads 26 and 27 both include a plurality of contact pins 28 that project from an upper surface of each test head, pins 28 being disposed to mate with a socket connector 29 that is connected to the electronic test circuitry (not shown) of the press by a shielded flat cable 30. Located on either side of pins 28 are mounting bores 31 that accept dowel pins 32 projecting from the lower surface of ram 21 to align and help secure test heads 26 or 27 to ram 21.

Test heads 26 and 27 also both present resiliently mounted left and right nylon plastic insulators 33 and 34 that each mount left and right signal emitting brass ram bars 35 and 36. Insulators 33 and 34 are carried by pins 44 that are resiliently mounted in each test head 26 and 27, allowing resilient engagement of ram bars 35 and 36 with cable 22 when ram 21 is extended. Insulators 33 and 34 are formed of a dielectric material to prevent conduction of the signal applied to ram bars 35 and 36 to any other part of press 20. Ram bars 35 and 36 are each disposed over and are aligned with left and right brass signal emitting track bars 37 and 38. Track bars 37 and 38 are electrically connected to the press test circuitry through a cable (not shown) to receive an oscillating test signal for application to multi-conductor flat cable 22 of an assembled harness to be tested. Ram bars 35 and 36 each present a resilient contacts 39 formed at a rear end of each bar and disposed to contact a rear end portion of each respective track bar 37 or 38 when a test head is in its extended termination position such that the signal applied to track bars 37 or 38 is conducted to and emitted by each respective ram bar 35 or 36.

Socket connector test head 26 is specially configured to terminate and test a lateral entry socket connector 40 by providing a plurality of resiliently mounted test pins 41 which are each conductively connected to one of contact pins 28 for insertion into each contact of socket connector 40 during termination of connector 40 to cable 22.

Card edge connector test head 27 is specially configured to terminate and test a card edge connector 42 by providing a circuit board 43 specially configured to mate with a card edge connector 42 during the termination of connector 42 to cable 22. Circuit board 43 includes a plurality of circuits conductively connected to contact pins 28 to conductively connect each contact of card edge connector 42 to the test circuitry of press 20. Circuit board 43 is secured within card edge connector test head 27 by screw fasteners 45 which allow easy removal of circuit board 43. Circuit board 43 is provided in a selection of different sizes corresponding to the number of contacts of the card edge connectors 42 to be terminated and tested in press 20. Thus card edge connector test head 26 is easily configured for a particular size of card edge connector 42 by securing the proper size circuit board 43 in test head 2 with fasteners 45.

Although all possible variations are not shown in the drawings, the present invention contemplates the use of a variety of modular interchangeable test heads that can be quickly exchanged to allow the termination and testing of a variety of different styles of connectors to a wire harness. For example, test heads could be specially adapted to test and terminate D-subminiature connectors, header connectors, dual in-line pin connectors and ribbon connectors.

The test circuitry for determining whether a terminated harness is faulty due to open or short circuits between adjacent conductive paths in the assembled harness is identical to that described in U.S. Ser. No. 07/521,623, filed May 9, 1990 which is incorporated herein by reference. The test circuitry includes test signal means for capacitively inducing an oscillatory signal in the conductor of a wire of the conductive path to be tested by applying the signal to either left or right track bars 37 or 38, depending upon the side of the harness to be tested, which in turn conducts the signal through contact 39 to the respective ram bars 35 or 36, and electrical continuity test means connected by shielded flat cable 30 to either socket connector test head 26 or card edge connector test head 27 which is conductively engaged with each respective conductive path of the harness through test pins 41 or card edge circuit board 43, for measuring the amplitude of the oscillatory signal at the connector outlet of each conductive path to be tested and comparing the measured amplitude to a predetermined amplitude value and for providing a fault signal indicative of the condition of the conductive path to be tested when the measured amplitude is equal to the predetermined amplitude value.

As best seen in FIG. 2, press 20 includes interchangeable left and right tray assemblies 48 and 49 and interchangeable connector tracks 50 and 51 which are respectively configured to position lateral entry socket connector 40 and card edge connector 42 for termination to flat cable 22.

Figure 10:
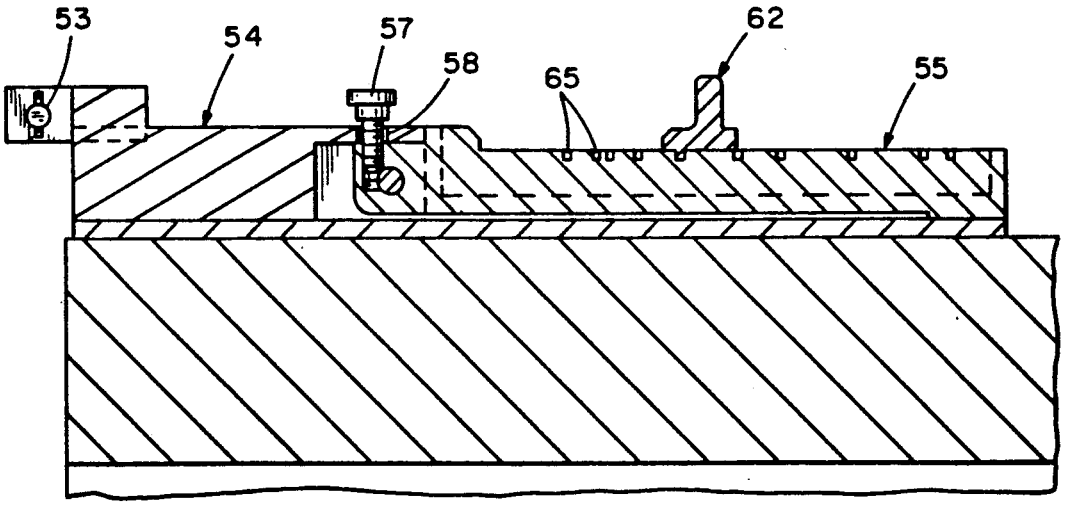
FIG. 10 is a fragmentary sectional view taken along line 10—10 of FIG. 3.
Figure 11:
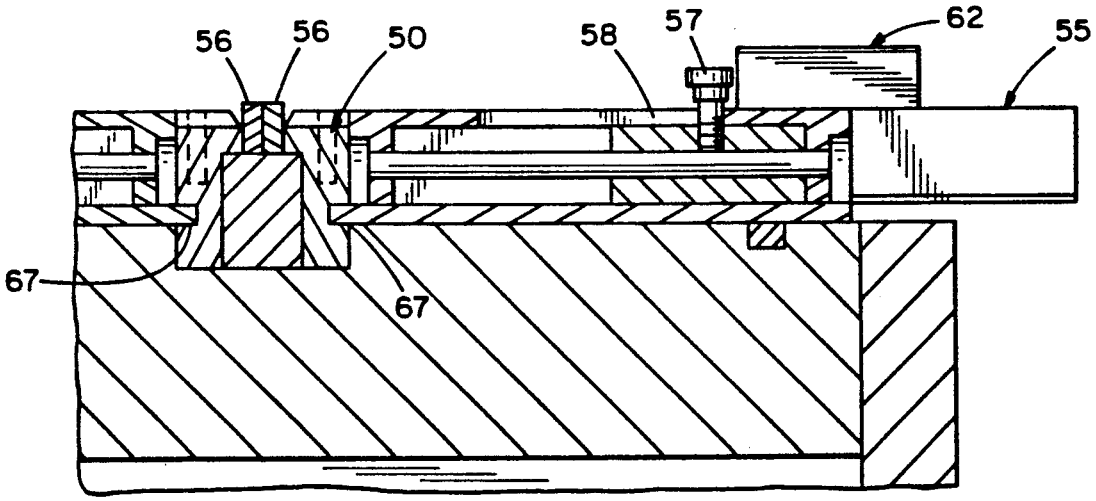
FIG. 11 is a fragmentary sectional view taken along line 11—11 of FIG. 3.

Left and right tray assemblies 48 and 49 are constructed as separable mirror image assemblies that can be used individually or secured by a locking pin 53 to be used as a unit depending upon the type of harness under construction. Tray assemblies 48 and 49 are constructed to individually or commonly engage the surface of press 20 for accurate sliding translation in a direction parallel to the length of ram 21 for advancement into an aligned position underneath press ram 21. Both tray assemblies 48 and 49 include main body 54 that movably mounts flat cable positioning trays 55 for translation in a direction perpendicular to the direction of advancement of the tray assemblies in the press. Adjustment knob 57 projecting from slot 58, as seen in FIG. 10, can be tightened to secure each tray 55 in one position relative to each main body portion 54. Each main body 54 includes a connector pusher. 56 disposed to align with slot 68 in tracks 50 and 51 to engage a connector and push it inwardly a the tray assembly is translated inwardly. An indicia scale 60 is provided on each main body 54 to facilitate accurate positioning of each tray 55.

Each tray 55 includes a plurality of connector positioning slots 61 formed on the surface of tray 55 parallel to the direction of advancement of each tray. Each slot 61 is formed with a width to accept the type of connector to be positioned in the slot. For example, slots 61 of trays 55 can be sized to accept and accurately position socket connector 40 or card edge connector 42. An adjustable cable guide 62 is slidably mounted on each tray 55 to accurately position a flat cable 22 between guide 62 and tray edge 63. Connector positioning slots 64 are formed in tray edge 63 to accept and position connectors. Guide positioning slots 65 are provided on the surface of tray 55 to accept an edge of guide 62 and resiliently latch guide 62 in a number of predetermined positions corresponding to the different standard sizes of connectors to be terminated in press 20. Cable guide 62 positions cable 22 and prevents twisting of cable 22 as tray assemblies 48 or 49 are advanced beneath press ram 21. Cable guide 62 includes a plurality of connector positioning slots 66 disposed opposite connector positioning slots 64 that are aligned with corresponding slots 61 on trays 55.

Interchangeable connector tracks 50 and 51 include guide slots 67 that engage flanges in the main body 54 of trays 48 and 49 to accurately guide the position of trays under ram 21. Tracks 50 and 51 present a connector positioning slot 68 extending the length of each track. A plurality of holes 69 formed on each edge of tracks 50 and 51 accept pins 70 of cable stop 71 to interchangeably mount stop 71 to position the distal end of cable 22. Stop 71 is configured to offset the distal edge of a flat cable 22 brought into abutment therewith relative to the position of a connector in tracks 50 and 51 to produce either flush or recessed orientation of the distal edge of cable 22 relative to a terminated connector. Rotation of stop 71 180 degrees changes the position of stop 71 from the flush to the recessed orientation.

Left and right track bars 37 and 38 are positioned at the inner, upper surface of tracks 50 and 51 on either side of the connector positioning slot 68. Tracks 50 and 51 are formed of a dielectric material to prevent the conduction of the test signal applied to track bars 37 and 38 to any other part of the press 20.

Figure 3:
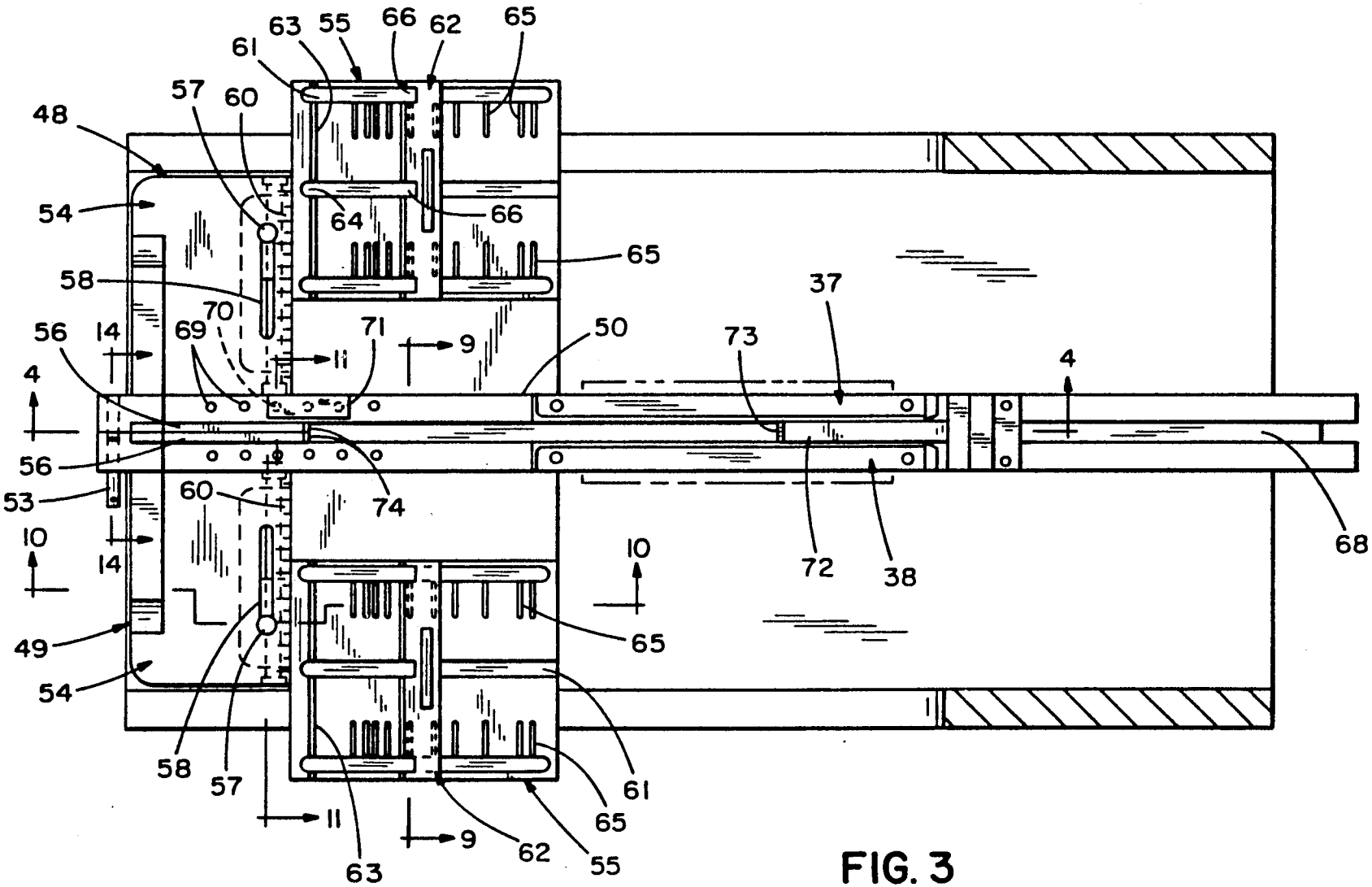
FIG. 3 is a sectional view taken along line 3—3 of FIG. 1.
Figures 4, 14:
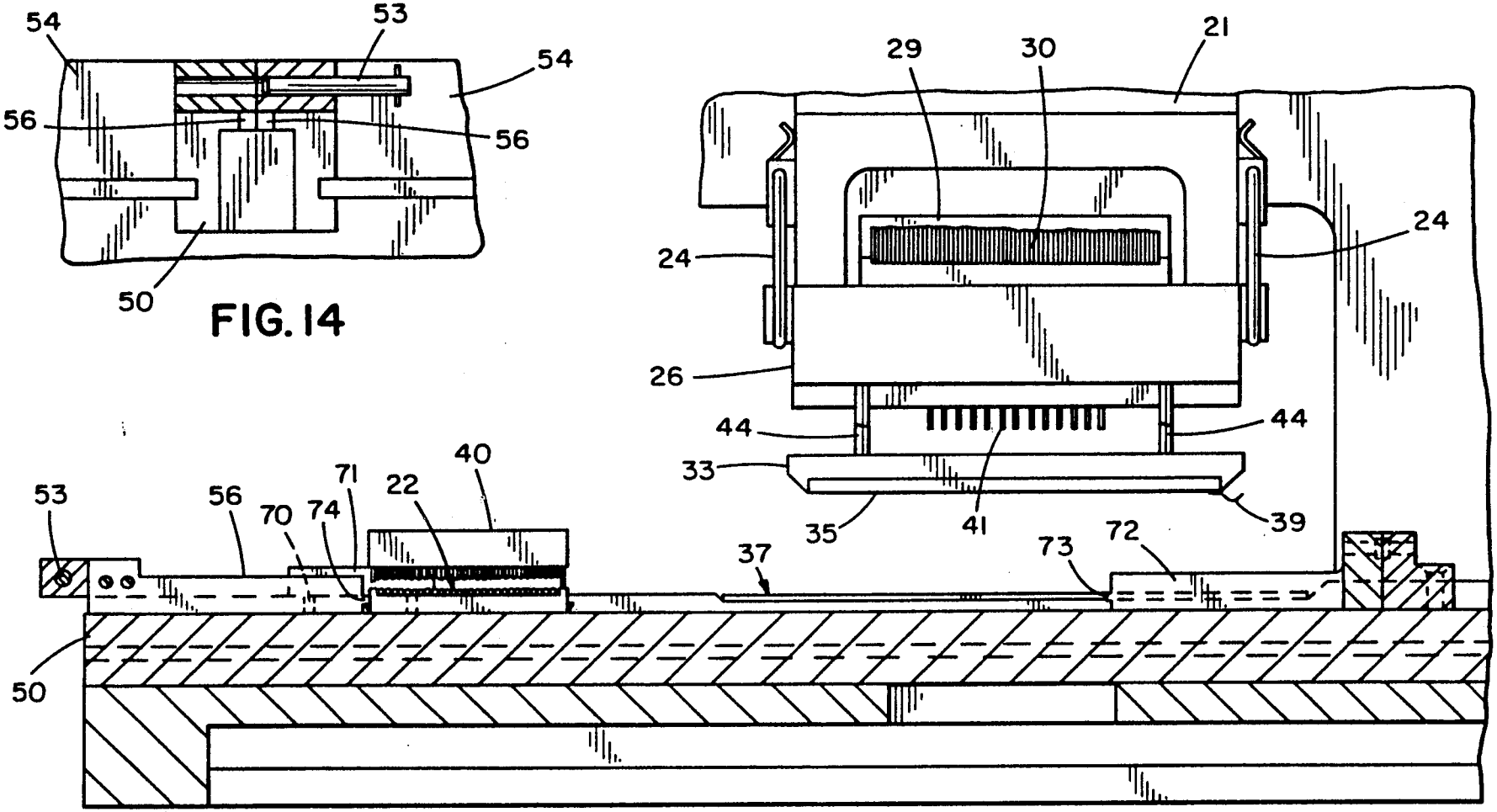
FIG. 4 is a fragmentary sectional view taken along line 4—4 of FIG. 3.
FIG. 14 is a fragmentary sectional view taken along line 14—14 of FIG. 3.

As seen in FIGS. 3 and 4, a track connector stop 72 is positioned in slot 68 of tracks 50 or 51 to stop and position a connector underneath ram 21 Track connector stop 72 includes a sensor switch (not shown) which provides an output to the press control circuitry to indicate a connector is in the track in the proper position underneath ram 21 for actuation of ram 21.

Figure 12:
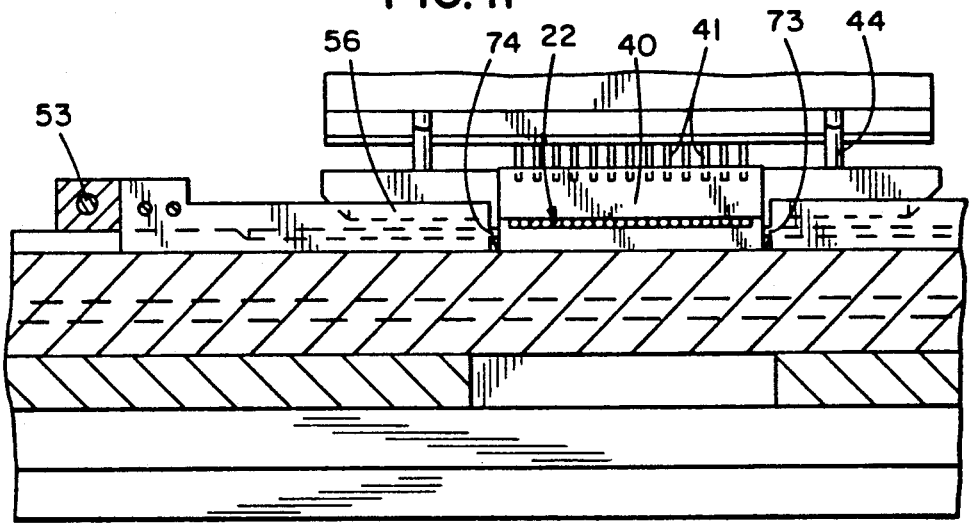
FIG. 12 is a fragmentary sectional view taken along line 12—12 of FIG. 6.
Figure 13:
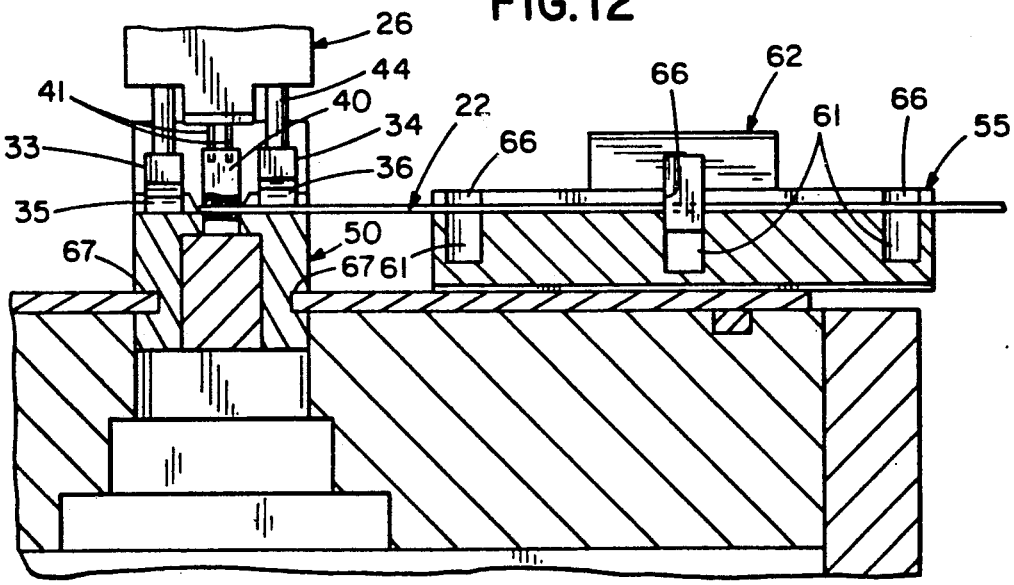
FIG. 13 is a fragmentary sectional view taken along line 13—13 of FIG. 6.

As best seen in FIG. 12, connectors 40 and 42 are stripped from test heads 26 or 27 by engagement of structural edges of each connector with first stripping edge 73 formed on the forward end of track connector stop 72 and a second stripping edge 74 formed on the distal end of connector pusher 56 of each tray assembly 48 or 49. When a tray assembly is advanced underneath ram 21 it drives a connector inwardly against track connector stop 72 trapping the connector between first and second stripping edges 73 and 74 which secure the connector against upward movement to prevent movement of the connector when ram 21 and test heads 26 or 27 are withdrawn after termination and testing is completed.

Figure 1:
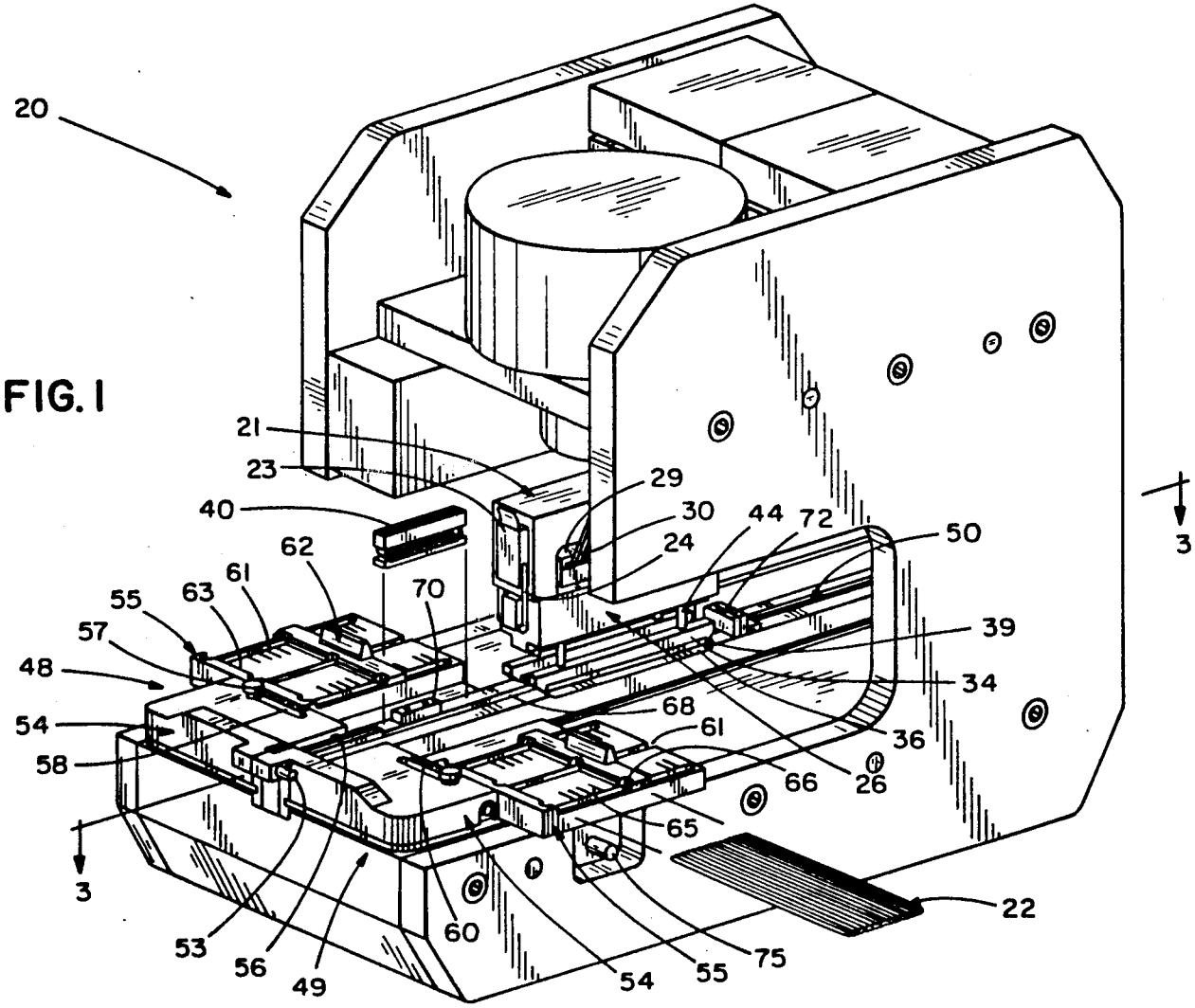
FIG. 1 is an isometric view of a modular connector press embodying the concept of the present invention.

As best seen in FIG. 1, the position of tracks 50 or 51 with respect to ram 21 is adjustable by securing a track positioning pin 75 within one a of plurality of detents (not shown) disposed along the length of each track to accurately position a track for a specific width of connector. Thus a track can be adjusted to accurately center connectors of different widths with respect to ram 21, when each connector is brought into abutment with track connector stop 72 carried on the track, to provide an even application of force across the width of the connector during termination. A linear potentiometer (not shown) connected to the press control circuitry senses the position of track 50 or 51 to ensure proper positioning of a connector relative to ram 21.

Figure 5:
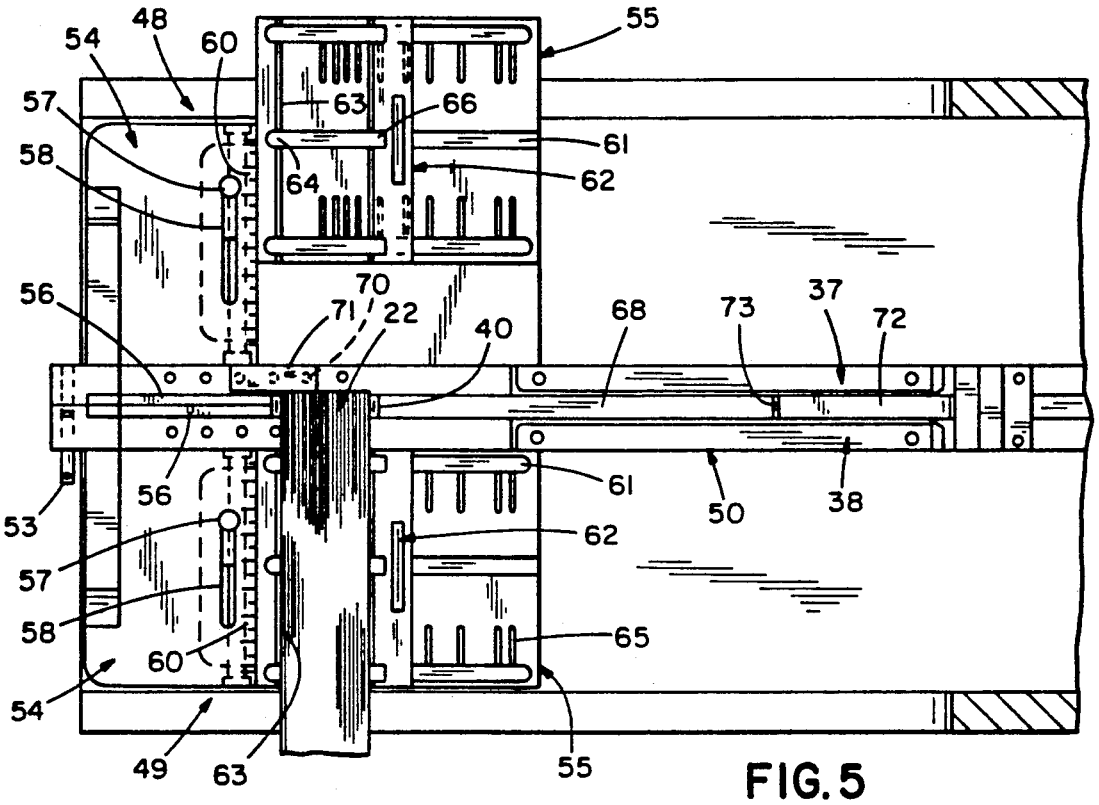
FIG. 5 is a fragmentary top view of the cable tray assembly positioning surface of the modular connector press of FIG. 1 showing the loading position of the right cable tray assembly.
Figure 6:
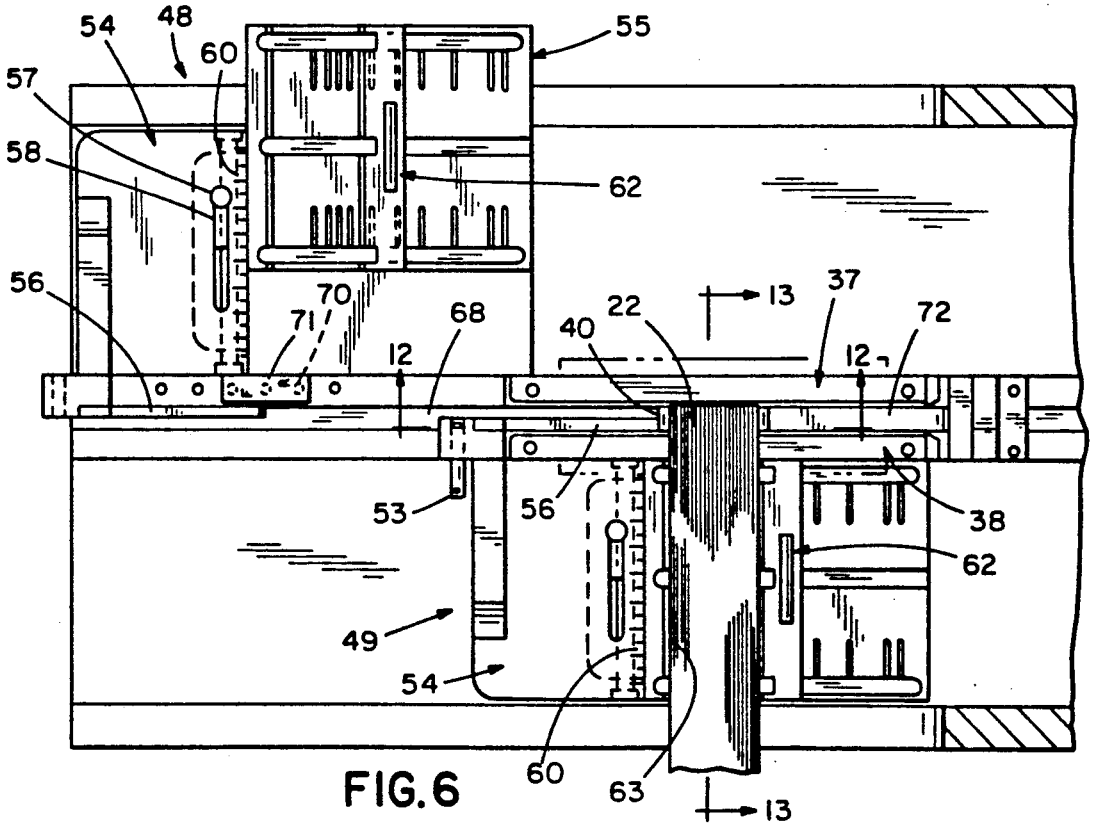
FIG. 6 is the same view as FIG. 5 showing the termination position of the right cable tray assembly.
Figure 7:
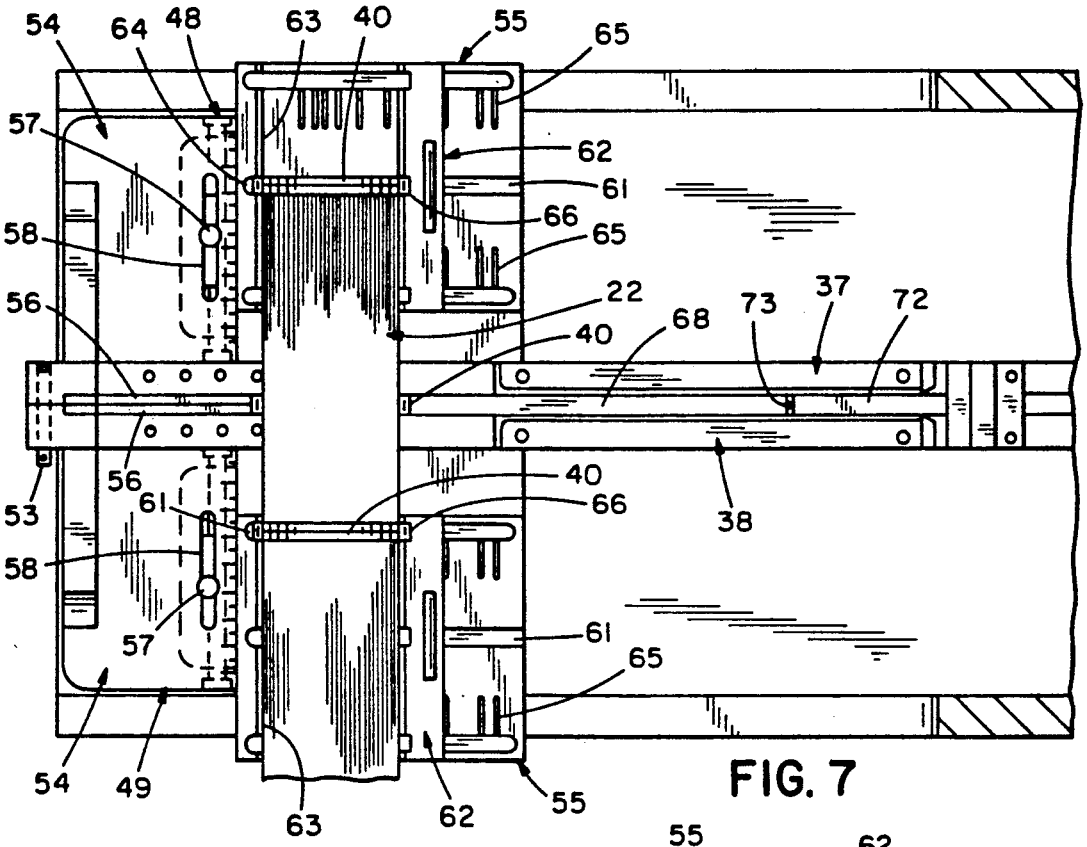
FIG. 7 is the same view as FIG. 5 showing the loading position of joined left and right cable tray assemblies.
Figure 8:
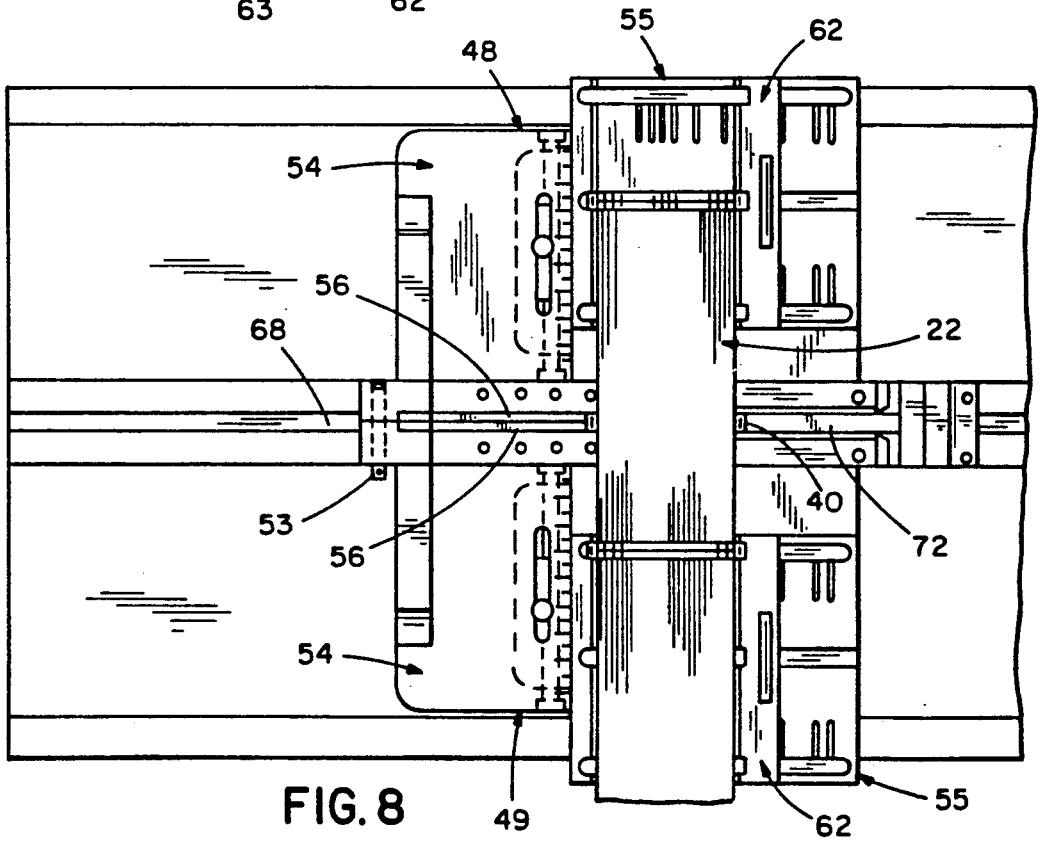
FIG. 8 is the same view as FIG. 5 showing the termination position of joined left and right cable tray assemblies.
Figure 9:
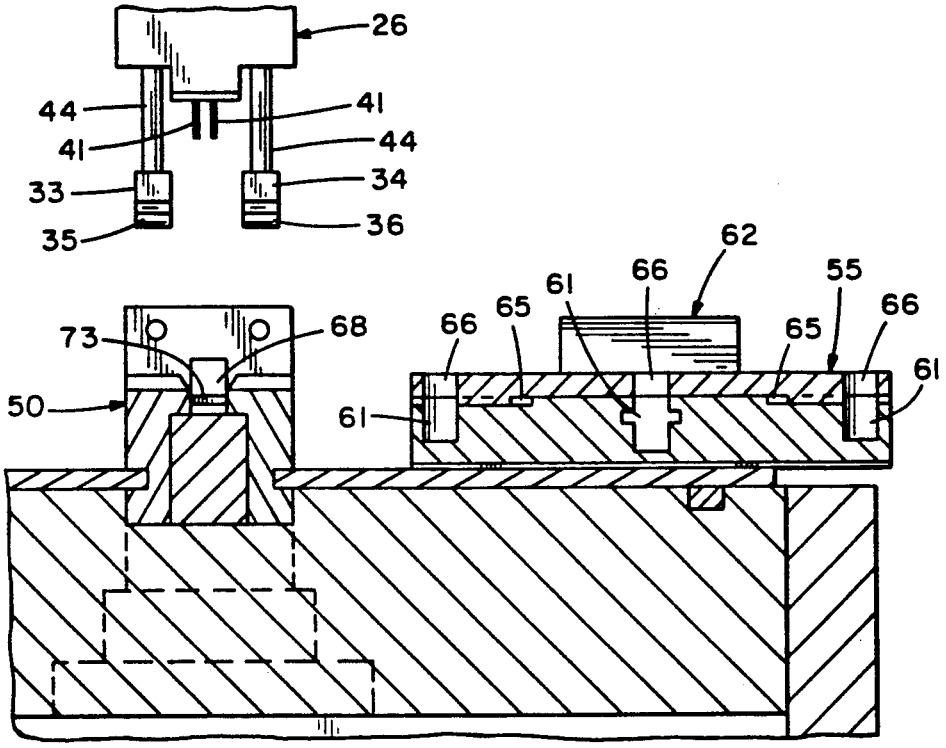
FIG. 9 is a fragmentary sectional view taken along line 9—9 of FIG. 3.

Left and right tray assemblies 48 and 49 can be quickly configured to be used individually, see FIGS. 5 and 6, to apply a connector to a harness by either a left or right handed operator or can be quickly configured to operate as a unit as seen in FIGS. 7 and 8, by securing left and right tray assemblies 48 and 49 together with locking pin 53, positioning connectors already terminated to a flat cable in slots 61 and adjusting the relative positions of trays 55, to allow the accurate application of a connector between the connectors already terminated to the flat cable.

Figure 15:
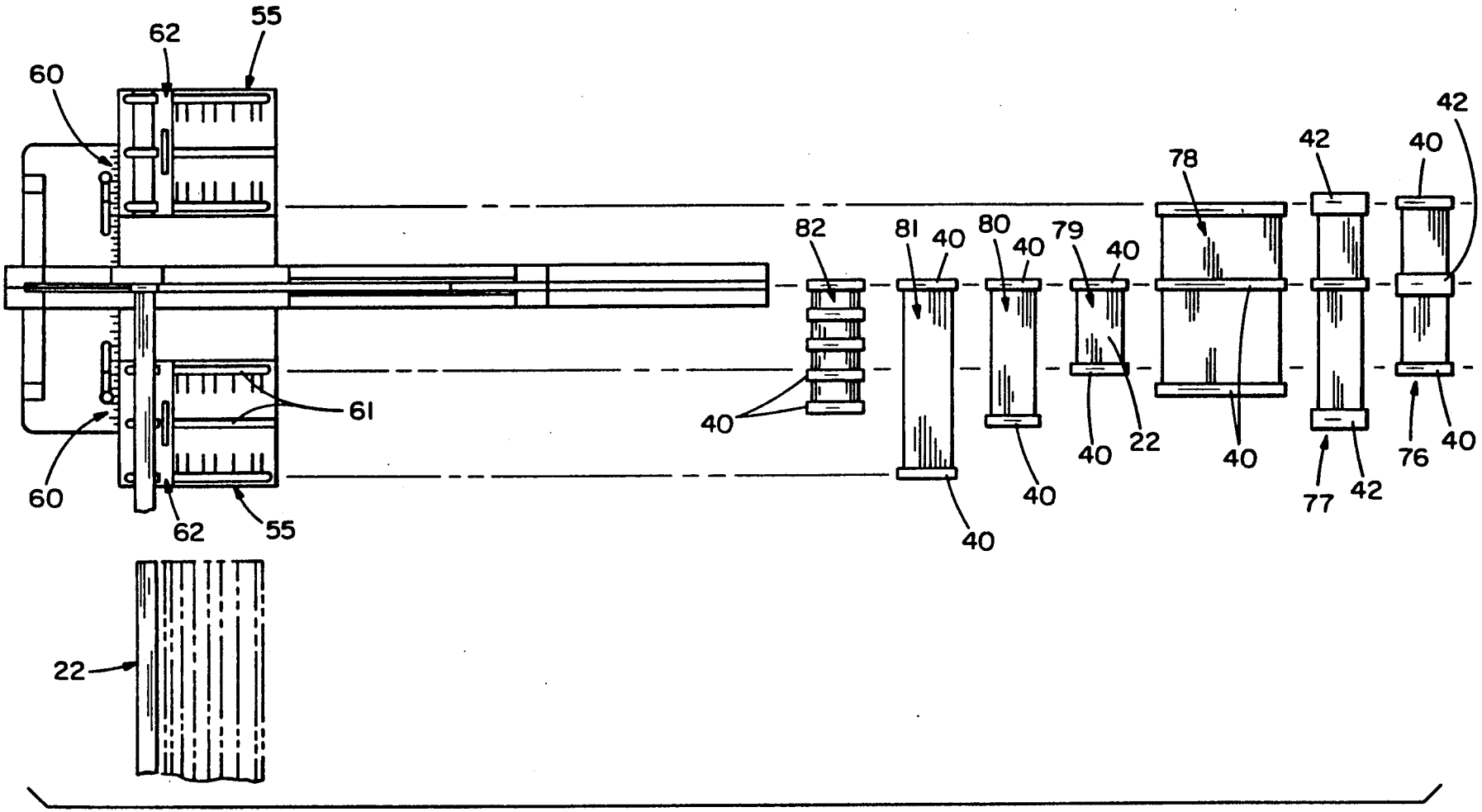
FIG. 15 is a top view of the cable tray assembly positioning surface showing a selection of the unlimited number of different connector harnesses that can be constructed with the modular connector press of the present invention.

As depicted in FIG. 15, the modular construction of tray assemblies 48 and 49 and the adjustability of trays 55 allow the construction of a great variety of different harnesses. A representative number of harnesses are illustrated in FIG. 15 including a socket-card edge-socket harness 76, a card edge-socket-card edge harness 77, and various configurations of socket connector harnesses of varying numbers of circuits illustrated by harnesses 78 through 82. These harnesses are only representative of the great variety of different combinations of connectors and connector positions in a harness that can be constructed by the present invention.

To construct a harness of a particular type of connector tray assemblies 48 and 49 and tracks 50 or 51 must be selected to match the connector type to slot 68 and match the connector selected to fit slots 61 of trays 55. Tray assemblies for different types of connectors can be fastened together with locking pin 53 and moved as a unit to accurately position different types of connectors positioned within slots 61 of each tray 55 for intermediate termination of a third connector, which by the selection of the appropriate type of track 55 and test head 26 or 27, can be of a third type of connector. For termination of a third connector between two connectors harness stop 70 is removed and each tray 55 is adjusted and locked in place by adjustment knob 57 in the direction transverse to the direction of translation of tray assemblies 48 an 49 to accurately position the line along cable 22, relative to ram 21, where it is desired to terminate the third connector.

Press 20 by the provision of the interchangeable modular test heads 26 and 27 and the interchangeable and adjustable tray assemblies and tracks provides for an extremely versatile press that can accurately position connectors relative to the length of the cable, terminate the connectors to the cable and test the harnesses for electrical faults.

We claim:

1. A connector press for terminating a connector to a flat cable to form a wire harness, comprising:

ram means mounted for reciprocation between a first position for receipt of the connector underneath the ram means and an extended position for compression and termination of the connector to the cable; and tray assembly means for accurately positioning and laterally translating the cable in a first direction transverse to the axial direction of the cable between a loading position for initial positioning of the cable and a termination position where the cable is positioned beneath the ram means, wherein the tray assembly means includes a main body, a cable tray, means for adjustably mounting the cable tray to the main body for translation of the cable tray in a second direction transverse to the first direction of translation of the tray assembly means and means for selectively securing the cable tray to the main body in one of a plurality of fixed positions.

2. A connector press as set forth in claim 1, including connector positioning means formed on the cable tray for accurately positioning a harness connector already terminated to the cable in parallel alignment with the first direction.

3. A connector press as set forth in claim 2, wherein the connector positioning means includes a slot formed in the surface of the cable tray having a width to accept and accurately position the harness connector.

4. A connector press as set forth in claim 1, including adjustable cable guide means formed on the surface of the cable tray for accurately positioning cables of varied widths on the surface of the cable tray.

5. A connector press as set forth in claim 4, wherein the adjustable cable guide means includes a first cable edge formed on the surface of the cable tray and a second edge formed on a cable guide that is mounted for selective movement on the surface of the cable tray between a plurality of predetermined positions corresponding to the widths of cables to be terminated in the press.

6. A connector press as set forth in claim 1, including interchangeable connector positioning tracks for accurately aligning different types of connectors with the ram means.

7. A connector press as set forth in claim 1, wherein the tray assembly means includes left and right tray assemblies disposed on either side of the ram means.

8. A connector press as set forth in claim 7, wherein the left and right tray assemblies include means for selectively fastening the left and right tray assemblies together for movement as a unit.

9. A connector press as set forth in claim 8, including connector positioning means formed on each cable tray for accurately positioning a harness connector already terminated to the cable in parallel alignment with the first direction.

10. A connector press as set forth in claim 9, wherein the connector positioning means includes a slot formed in the surface of each cable tray having a width to accept and accurately position the harness connector.

11. A connector press as set forth in claim 10, including adjustable cable guide means movably mounted on the surface of each cable tray for accurately positioning cables of varied widths on the surface of each cable tray.

12. A connector press as set forth in claim 11, wherein the adjustable cable guide means includes a first cable edge formed on the surface of each cable tray and a second edge formed on a cable guide that is mounted for selective movement on the surface of each cable tray between a plurality of predetermined positions corresponding to the widths of cables to be terminated in the press.

13. A connector press as set forth in claim 12, including interchangeable connector positioning tracks for accurately aligning different types of connectors with the ram means.

14. A connector press for terminating a connector to a flat cable to form a wire harness, comprising:

ram means mounted for reciprocation between a first position for receipt of the connector underneath the ram means and an extended position for compression and termination of the connector to the cable; and interchangeable tray assembly means for accurately positioning and laterally translating the cable in a first direction transverse to the axial direction of the cable between a loading position for initial positioning of the cable and a termination position where the cable is positioned beneath the ram means, wherein the tray assembly means includes a cable tray, connector positioning means formed on the cable tray for accurately positioning a harness connector already terminated to the cable in parallel alignment with the first direction and adjustable cable guide means formed on the surface of the cable tray for accurately positioning cables of varied widths on the surface of the cable tray wherein the connector positioning means is spaced inwardly from an edge of the cable tray aligned with the ram means and disposed adjacent to the adjustable guide means such that wire harnesses of varying cable and connector widths can be accurately positioned on the tray for termination of an additional connector to the wire harness in the connector press.

15. A connector press as set forth in claim 14, wherein the connector positioning means includes a slot formed in the surface of the cable tray having a width to accept and accurately position the harness connector.

16. A connector press as set forth in claim 15, wherein the adjustable cable guide means includes a first cable edge formed on the surface of the cable tray and a second edge formed on a cable guide that is mounted for selective movement on the surface of the cable tray between a plurality of predetermined positions corresponding to the widths of cables to be terminated in the press.

17. A connector press as set forth in claim 14, including interchangeable connector positioning tracks for accurately aligning different types of connectors with the ram means.

18. A connector press as set forth in claim 14, wherein the tray assembly means includes a plurality of interchangeable left and right tray assemblies disposed on either side of the ram means, wherein the connector positioning means of each tray is configured to position different types of electrical connectors such that wire harnesses of different types of connectors can be constructed by the selection of the appropriate tray assembly.

19. A connector press as set forth in claim 18, wherein the left and right tray assemblies include means for selectively fastening the left and right tray assemblies together for movement as a unit.

20. A connector press as set forth in claim 19, wherein the connector positioning means includes a slot formed in the surface of each cable tray having a width to accept and accurately position the harness connector.

21. A method of accurately positioning and terminating a third connector between first and second connectors terminated to a flat cable to form a wire harness in a connector press having ram means mounted for reciprocation between a first position for receipt of the connector underneath the ram means and an extended position for compression and termination of the connector to the cable; and having left and right tray assembly means disposed on either side of the ram means for accurately positioning and laterally translating the harness in a first direction transverse to the axial direction of the cable between a loading position for initial positioning of the cable and a termination position where the cable is positioned beneath the ram means, wherein the left and right tray assembly means each includes a main body, a cable tray and means for mounting the cable tray to the main body to allow adjustable translation of the cable tray in a second direction transverse to the first direction of translation of the tray assembly means and wherein each cable tray includes connector positioning means formed on each cable tray for respectively positioning the first and second harness connectors in parallel alignment with the first direction, comprising the steps of:

positioning the first connector on the connector positioning means of one of the cable trays;

positioning the second connector on the connector positioning means of the other of the cable trays;

adjusting the position of the cable trays in the second direction to position the harness with respect to the ram means such that the harness is positioned to terminate the third connector in a desired location; and terminating the third connector to the harness in the third location.

* * * * *